United States Patent [19]

Mallek

[11] Patent Number: 5,010,828

[45] Date of Patent: Apr. 30, 1991

[54] GASIFICATION REACTOR FOR COMBUSTIBLE SOLID MATERIAL

[75] Inventor: Heinz Mallek, Linnich, Fed. Rep. of Germany

[73] Assignee: Forschungszentrum Jülich GmbH, Jülich, Fed. Rep. of Germany

[21] Appl. No.: 556,824

[22] Filed: Jul. 23, 1990

[30] Foreign Application Priority Data

Jul. 26, 1989 [DE] Fed. Rep. of Germany ..... 3924626

[51] Int. Cl.[5] ..... F23G 5/00; F23G 5/12

[52] U.S. Cl. ..... 110/256; 48/123; 110/229

[58] Field of Search ..... 110/251, 256, 229, 258; 48/123

[56] References Cited

U.S. PATENT DOCUMENTS

| | | | |
|---|---|---|---|
| 4,194,455 | 3/1980 | Mallek et al. | 110/251 |
| 4,538,528 | 9/1985 | Faehnle | 110/229 |
| 4,561,363 | 12/1985 | Mallek . | |
| 4,643,109 | 2/1987 | Meyer | 110/256 X |

*Primary Examiner*—Edward G. Favors

*Attorney, Agent, or Firm*—Frishauf, Holtz, Goodman & Woodward

[57] ABSTRACT

A gasification shaft in the reactor collects a loose heap of solid waste matter on a support at the bottom of the shaft in the form of a triangular hollow prism having longitudinal edges leaving gaps between it and the walls of the shaft. The support can be swung about its axis to open the gaps wider and shake the solid material. Oxygen containing gas is supplied at the top of the shaft and supports partial combustion of the solid material. Gas and partly burned solid material pass down through the variable gaps into a combination chamber below the shaft into which more oxygen containing gas is fed both from above through the prismatic support and from below through an ash chamber at the bottom of the combustion chamber after passing through lower gaps between an emptying device of triangular prism shape, below which is an ash removal chamber. The additional oxygen supplied from below into the combustion chamber assures the complete combustion of the solid material so that treatment of the ash outside of the reactor becomes unnecessary.

7 Claims, 1 Drawing Sheet

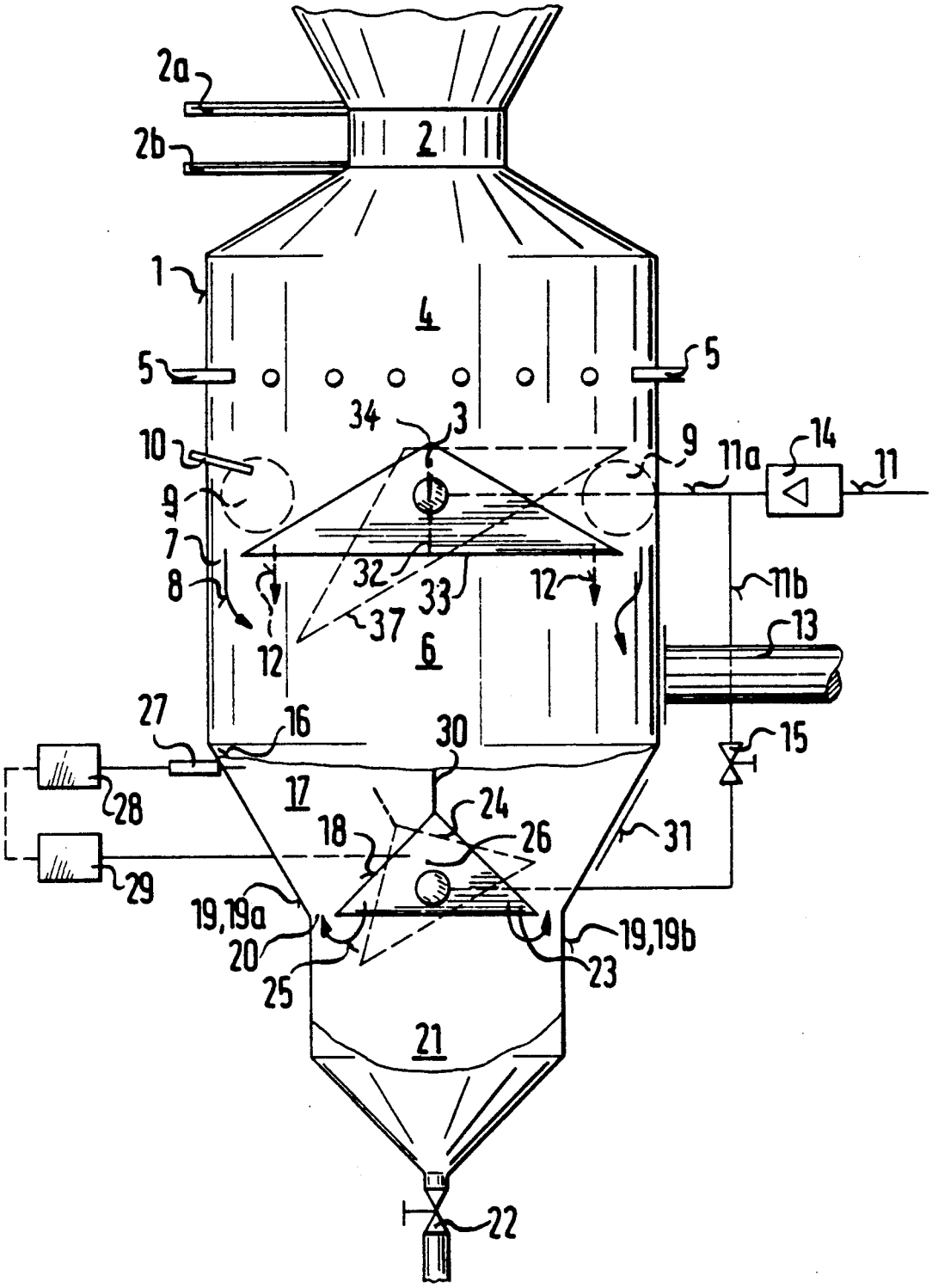
2a
2b
2
1
4
5
5
34
3
10
9
11a
14
11
9
7
8
32
33
12
11b
37
13
12
6
27
16
30
15
28
17
24
18
26
31
29
19,19a
20
25
19,19b
23
21
22

GASIFICATION REACTOR FOR COMBUSTIBLE SOLID MATERIAL

This invention concerns a gasifying reactor having a gasification shaft in which the fuel solids form a loose aggregation which is supported on a movable support in the shaft and in which a supply duct discharges a gasification medium containing oxygen into the shaft or into the solid aggregate above the support which is for gasification and partial combustion of the solid in the solid aggregate. A combustion chamber is located below the support for the combustible fuel gas and residual solid ash formed in the solid aggregate and issuing therefrom into the combustion chamber through the passage openings provided for that purpose. A gas withdrawal pipe for sucking off the combustion gases ignited in the combustion chamber that closes off the bottom of the combustion chamber. The ashes falling through the passage openings are collected in an ash chamber that is located underneath the support and closes off the bottom of the combustion chamber.

A reactor for gasifying combustible solids and for burning the gases produced from the solids is known from U.S. Pat. No. 4,561,363. The reactor serves for gasifying solids such as coal, charcoal or wood, and especially for gasifying wood and paper waste or mixed combustible waste. The fuel gas is generated in the reactor by incomplete combustion of the solids to which air, oxygen and/or steam is supplied as a gasification medium. In this process the solid in the gasification shaft moves through a pyrolysis zone by gravity and is first dried and then gasified in that zone. The coked solid material thereby produced is ignited in the lower portion of the solid aggregate and is partly burned with the formation of an incandescent zone. The low temperature carbonization gas formed in the pyrolysis zone is led through the incandescent zone. This gas flows downward in a movement concurrent with that of the solids through the solid aggregate and thus before leaving the aggregate passes through the incandescent zone, so that the tar and oil components contained in the low temperature carbonization gas are cracked and converted into carbon compounds of lower molecular weight, particularly methane. Pressure less than atmospheric pressure is provided in the gasification shaft of the reactor in order to maintain the downwardly directed stream of low temperature carbonization gas. The cracked low temperature carbonization gas is ignited within a combustion chamber underneath the gasification shaft and is burned. The energy thus obtained is transferred as useful heat to a secondary heat transfer medium in a heat exchanger on the exit side of the combustion chamber.

Below the combustion chamber the known reactor has an ash exit lock for removal of the ashes which come out of the solid aggregate. The ash lock is constructed in such a way as to prevent admission of any uncontrolled supply of air into the combustion chamber. In consequence it is necessary to tolerate the presence of incompletely burned material remaining in the ashes which are carried out of the solid aggregate and which are converted only after a later removal of the ashes to the exterior of the reactor. The gases that then arise do not satisfy the requirements regarding waste gas and may not be discharged into the environment without supplementary treatment.

SUMMARY OF THE INVENTION

It is an object of the invention to provide a gasification reactor having an ash chamber in which the incompletely burned solid residues contained in the ashes can be completely burned out.

Briefly, at the bottom of the ash chamber a movable emptying device for the ashes is so provided that passages remain available for introducing oxygen-containing gases into the ashes. Enough gas is thus led through the ashes to consume completely the unburned solid portions. The emptying device is made movable so that by its movement ashes can be drawn out of the ash chamber. This control of the ash removal has the purpose of maintaining approximately constant the ash layer depth in the ash chamber which is to be penetrated by gas. The size and weight of the ash layer and the resulting low through-resistance for the oxygen-containing gas entering into the combustion chamber and also the underpressure reigning in the combustion chamber or the pressure difference between the passages and the combustion chamber, determine the amount of gas that flows through the ash layer.

It is useful for the introduction of the oxygen-containing gas for the ash emptying device to be connected with at least one gas duct for oxygen-containing gas and to provide exit orifices of the gas duct in the region of the passages to the ash chamber. The oxygen containing gas is in this fashion introduced directly into the ash chamber.

In a further development of the invention a prismatic construction of the emptying device and a movement of the emptying device about the prism axis is provided. The emptying device is pivoted so as to swing in the ash chamber in such a way that open gaps remains between prism edges and the bottom of the ash chamber has passages through which not only can the oxygen-containing gas flow into the ash layer, but also the burned ashes can be brought out of the ash chamber. The width of the gaps is then such as to accommodate the ash particles produced while taking into account the desired gas flow. The prismatic construction of the emptying device makes it possible to allow the gas duct for the supply of oxygen-containing gas to discharge into the free interior space of the emptying device and to provide gas exits from the interior in the region of the prism edges for leading the gas to the passages. For a continuous removal of ashes it is desirable for two opposite bottom wall of the ash chamber to be downwardly and convergingly inclined, in such a way that between prism walls and inclined bottom wall portions there will be provided an ash exit openly terminating at the gas inflow openings. The inclination of the prism walls and of the lower wall parts is to be determined according to the inclination of the heap of solid residues carried out of the gasification shaft into the combustion chamber and collecting as ashes produced by complete burning up of these solid residues.

With a movement of the emptying device, the removal of the ashes through the passages leading them out of the ash chamber is accelerated. Any bridges formed by ash particles at the ash exit are broken up. In order that solid residues that interfere with the transport of the ashes may be removed in the upper portion of the ash layer, an ash rake projecting into the ash layer is attached to the top of the emptying device and is movable with the emptying device. Below the emptying device an ash removal hopper is provided.

BRIEF DESCRIPTION OF THE DRAWING

The invention is further described below by way of example with reference to the annexed drawing, the single figure of which shows a schematic axial cross-section of an embodiment of a reactor according to the invention.

DESCRIPTION OF THE ILLUSTRATED EMBODIMENT

The drawing shows a gasification reactor of rectangular horizontal cross-section seen in side elevation. It has a gasification reactor having a gasification shaft 1 in which combustible solids, for example wood shavings, also coated wood, coals, paper or other combustible waste materials are charged through a filling device 2. In the illustrated case a shift sluice serves as the filling device In its operation slides 2*a* and 2*b*, which are so locked together so that at any time only one of the slides, 2*a* or 2*b*, can be opened at any time, in order to prevent the inrush of air into the gasification shaft or the escape of gas therefrom, so far as possible, during the operation of putting a charge of waste material into the gasification reactor.

The combustible solid material in the gasification shaft 1 produces a heap of loose, aggregated solid matter not shown but occupying the space and lying on a movable support 3. In the illustrated example a long and hollow triangular prism is installed as the support 3 and is shown in the drawing only in cross-session. In the position shown in solid lines the prism is symmetrical about a plane represented by the vertical chain-dotted line 32 which is perpendicular to its base 33 and passes through the apex 34. The prism is mounted so as to swing about its central longitudinal axis.

One of the swung out positions of the prismatic support 3 is shown in the broken line outline 37. Above the support 3 are located supply ducts 5 for the introduction of a gasification medium containing oxygen. In the illustrated case air flows from the ducts 5 into the aggregate of solid material 4.

Below the support 3 there is located a combustion chamber 6 for the combustion gas issuing downwardly out of the gasification shaft 1 through passage openings 7 that are located between the support 3 and walls of the gasification shaft 1. The flow of the combustion gas is indicated in the drawing by the arrows 8. The combustion gas is generated by gasification pyrolysis of the solid material in the aggregate 4. For this gasification and pyrolysis the solid material in the gasification shaft 1 passes, under the force of gravity, at first through a drying zone and then through a gasification zone which adjoins incandescent zones 9 marked in broken lines in the drawing. Each incandescent zone 9 is generated by partial combustion of the solid material and, depending upon the particular waste material, has a temperature in the temperature range between 700° and 1000° C. A device 10 is used for ignition of material in the incandescent zone at the start of operation while the gasification reactor is cold.

The incandescent zones 9 are located directly above the passage openings 7 between the support 3 and the walls of the gasification shaft 1. In the illustrated case, with prismatic construction of the support 3 there remain elongated slots between the walls of the gasification shaft and the prism edges of the support 3, serving as the passage openings 7, the opening width being in the range from 10 to 50 mm, preferably about 30 mm, for the position shown in solid lines.

The low temperature carbonization gas produced by pyrolysis in the gasification zone within the solid material heap flows through the gasification shaft in the same direction as the fuel falls or settles through the shaft. Before entrance into the combustion chamber 6 this gas penetrates through an incandescent zone 9 formed above the passage openings 7. The low temperature carbonization gas is thereby heated to a temperature at which the high molecular weight of components of the carbonization gas are cracked. As a result a gas is formed that contains essentially CO, $H_2$ and $CH_4$.

The hot combustion gas finally passing through the passage openings 7 is ignited in the combustion chamber 6 by the supply of additional oxygen. A portion of the oxygen required for the operation is introduced in the illustrated example through the interior of the prismatic support 3 into the combustion chamber 6. The support 3 is connected with an air duct 11 schematically shown in the drawing. The branch duct 11*a* supplies air which flows into the hollow space within the support 3. Outlet openings for the air are located in the lower part of the interior space of the support. The air flowing out into the combustion chamber 6 is designated in the drawing by broken line arrows 12.

After its ignition in the combustion chamber 6 the burned fuel gas flows out through out a gas withdrawal line 13. The gas withdrawal line leads to a heat exchanger not shown in the drawing for transfer of the generated heat to a heat transfer medium for recovery of the useful heat.

The air required in the combustion chamber 6 for gas combustion is obtained from the environment by suction For this purpose a blower 14 is provided which is installed in the air duct 11. The air sucked in by the blower 14 flows to the combustion chamber either through the air duct branch 11*a*, which leads the air to the support 3, from which it can go out into the combustion chamber 6. It is also introduced into the combustion chamber 6 through the ashes after passing through a correspondingly installed regulator 15 in the air duct 11*b* and to and through the interior of a prismatic emptying device 18 arranged in the ash chamber 16 below the ash layer 17. Solid residues in the ashes still unburned after passage through the incandescent zones 9 are completely burned up by the passage of the air through the ash layer 17.

The ash chamber 16 is located below the support 3 for the solid matter aggregate and closes off the bottom of the combustion chamber 6. In the illustrated example oblique bottom walls 19 of the ash chamber 16 have opposite wall portions 19*a* and 19*b* extending obliquely downwards towards each other. The inclination of the bottom wall parts 19*a* and 19*b* is set for the heaping angle of the ashes falling into the ash layer 17. The ashes drop into the ash chamber by gravity towards the movable prismatic emptying device 18 and then through passages 20 into an ash hopper 21 which is disposed beneath the emptying device 18. From this ash hopper 21 the ashes can be released through an ash outlet valve 22 into a removable ash container not shown in the drawing.

The passages 20 for emptying the ashes are on each side of the emptying device 18. In the illustrated example the passages 20 serve at the same time as inlet openings for the air supplied over the duct branch 11*b* to the emptying device 18. In the illustrated example the emptying device 18 is of prismatic shape. The passages 20 are located between prism edges 23 of the emptying device 18 and the lower wall portions 19a and 19b respectively of the ash chamber 16. The passages 20 have the shape of lengthwise slots the width of which, in the position shown in solid lines, is between 5 and 50 mm, preferably 15 mm. The particular slot width selected for the passages 20 is determined by the particle size of the ashes.

In the illustrated example the emptying device 18 has a hollow space 24 into which the air duct branch 11b discharges. The hollow space 24 has exit openings for the air at the bottom of the emptying device 18. The outflowing air is shown in the drawing by flow arrows 25. The air flows first into the internal space of the ash hopper 21 and from there goes through the passages 20 into the ash layer 17. In flowing through the ash layer 17, still unburned ash portions are completely consumed, so that only incombustible ash residues fall into the ash hopper 21. The emptying device 18 can be swung about its horizontally arranged prism axis 26 in the ash chamber 16. One of the possible swung out positions is designated in the drawing with broken lines By swinging of the emptying device 18 it is possible, on one hand, to break up ash bridges in the ash layer which block the passage of ashes and, on the other hand, to accelerate the outflow of ashes if the ash layer 17 rises too high for the passage of air for burning the still unburned ash portions.

The thickness of the ash layer 17 determines on the one hand the flow resistance provided for the air stream and, on the other hand, the kind and manner of gas flow through the ash layer. A strong turbulance of the ashes resulting from the gas flow is to be avoided just as much as the quiet formation of gas channels which do not permit a uniform distribution of the air within the ash layer. The movement of the emptying device 18 is controlled primarily in dependence on the height reached by the ash layer 17 in the ash chamber 16. A corresponding sensor 27 for the height of the ash layer provides, in the illustrated example, electric signals to a regulator 28 for control of a drive unit 29 for moving the emptying device 18.

In the illustrated example an ash rake 30 is fastened to the prismatic emptying device 18 at the apex ridge of the prism. When the emptying device 18 is swung, the ash rake 30 moves with it and thus takes care of loosening ash components that may have become blocked in position. The ash rake 30 consists of a row of teeth which are straight in the illustrated example but could also be bent or hooked. Such an ash rake is advantageous particularly when the solid residues issuing out of the solid material aggregate into the ash chamber has no sufficiently uniform particle or piece size and therefore disturb the provision of any transport of ashes in the ash layer 17. For emptying of ash portions which cannot pass through the passages 20 because of their blocking size or shape, the emptying device 18 can be swung by an angle that provides openings of maximum size. For removal of blocking material, the ash chamber also has a lateral ash removal flap-door 31.

EXAMPLE OF OPERATION

In a gasification reactor of the illustrated type lignite was converted into fuel gas. In the incandescent zone the temperature was 750° C. In gasification of the lignite a weak gas was produced in the gasification shaft having the following gas quality: $CO=20$ vol. %, $H_2=12$ vol. %, $CH_4=1.2$ vol. % and $CO_2=8$ vol. %. With this composition the weak gas has a lower minimum heating value of 4300 kJ/m$^3$.By introduction of air into the ash layer 17 a carbon-poor ash could be produced. The fully reacted ash had 1% by weight of residual carbon With conversion of a low temperature carbon gas generated from nut shells at a temperature between 750° and 800° C., a fuel gas was formed in the incandescent zone 9 which was a weak gas having the following composition $CO=22$ vol. %, $H_2=10$ vol %, $CH_4=1$ vol %. That corresponds to a minimum heating value for the weak gas of about 4200 kJ/m$^3$.

Although the invention has been described with reference to a particular example, it will be understood that modifications and variations are possible within the inventive concept.

I claim:

1. A gasifying reactor for combustible solid materials having a gasification shaft, a movable support at the lower end of said shaft for accumulation thereabove a loose filling of solid material in said shaft, said movable support leaving gaps between at least its principal edges and walls of said shaft for passage of gases and solid material pieces, mains for supplying an oxygen containing gasification medium for gasification and partial combustion of solid material in said accumulation of solid material above said support, a combustion chamber below said support for combustion of gas passing through said passages which is generated in said accumulation of said material, gas suction means connected to said combustion chamber for removal of gases produced by combustion and an ash chamber below said combustion chamber and closing the bottom thereof for receiving solid materials converted in part to ashes falling through said passages and through said combustion chamber, characterized in that:

a movable emptying device (18) for ashes is provided at the bottom of said ash chamber (16) in such a way that passages (20) remain between edges of said emptying device and walls of said ash chamber for introducing an oxygen containing gas into the ashes in said ash chamber from below, said passages being subject to change of width during movement of said device.

2. The gasification reactor of claim 1, characterized in that:

said emptying device (18) is connected with at least one gas supply duct (11, 11b) for leading oxygen containing gas through orifices located on the underside of said emptying device for favoring a gas flow into said ash chamber through said passages (20).

3. The gasification reactor of claim 2, characterized in that:

said emptying device (18) is of prismatic shape and is swingable about its prism axis (26) in said ash chamber (16) in such a way that open slots remain as passages (20) between prism edges (23) of said emptying device (18) and walls (19, 19a, 19b) of said ash chamber.

4. The gasification reactor of claim 3, characterized in that:

at least one gas duct (11b) communicates with substantially clear interior space (24) of said emptying device (18) and said emptying device has gas exit openings for said interior space (24) in the proximity of said prism edges (23).

5. The gasification reactor of claim 4, wherein said walls (19, 19*a*, 19*b*) of said ash chamber (16) are downwardly and convergingly inclined towards said passages (20), so that prism walls of said emptying device (18) and inclined wall portions (19*a*, 19*b*) of said ash chamber form narrowingly converging ash exits opening into said passages.

6. The gasification reactor of claim 1, characterized in that an ash rake is attached to an upper portion of said emptying device (18) and is movable with said emptying device.

7. The gasification reactor of claim 1, wherein an ash removal hopper and hopper valve (22) are provided below said emptying device (18).

* * * * *